US010385787B2

(12) United States Patent
Kopecek et al.

(10) Patent No.: US 10,385,787 B2
(45) Date of Patent: Aug. 20, 2019

(54) METHOD OF REGULATING AN INTERNAL COMBUSTION ENGINE INCLUDING OMISSION OF CYLINDER FIRINGS

(71) Applicant: INNIO Jenbacher GmbH & Co OG, Jenbach (AT)

(72) Inventors: Herbert Kopecek, Schwaz (AT); Nikolaus Spyra, Innsbruck (AT); Michael Waldhart, Telfs (AT)

(73) Assignee: INNIO Jenbacher GmbH & Co OG, Jenbach (AT)

( * ) Notice: Subject to any disclaimer, the term of this patent is extended or adjusted under 35 U.S.C. 154(b) by 122 days.

(21) Appl. No.: 14/728,198

(22) Filed: Jun. 2, 2015

(65) Prior Publication Data

US 2015/0354471 A1 Dec. 10, 2015

(30) Foreign Application Priority Data

Jun. 4, 2014 (AT) ..... 437/2014

(51) Int. Cl.
*F02D 17/02* (2006.01)
*F02D 41/00* (2006.01)
*F02B 75/18* (2006.01)

(52) U.S. Cl.
CPC ..... *F02D 17/02* (2013.01); *F02D 41/008* (2013.01); *F02D 41/0087* (2013.01); *F02B 2075/1848* (2013.01); *F02B 2075/1868* (2013.01); *F02D 2250/18* (2013.01)

(58) Field of Classification Search
CPC ..... F02D 17/02; F02D 41/008; F02D 41/0087
USPC ..... 123/198 DB, 198 DC; 701/112
See application file for complete search history.

(56) References Cited

U.S. PATENT DOCUMENTS 5,502,966 A 4/1996 Unland et al.
5,826,563 A 10/1998 Patel et al.
6,360,724 B1 * 3/2002 Suhre ..... F02D 17/02 123/198 F (Continued)

FOREIGN PATENT DOCUMENTS

CN 103670731 A 3/2014
DE 29 28 075 2/1981

(Continued)

OTHER PUBLICATIONS

Austrian Search Report dated Jun. 2, 2015 in Austrian Patent Application No. A 437/2014.

(Continued)

*Primary Examiner* — Erick R Solis
*Assistant Examiner* — Robert A Werner
(74) *Attorney, Agent, or Firm* — Fletcher Yoder, P.C.

(57) ABSTRACT

A method of regulating an internal combustion engine having a plurality of cylinders is provided, wherein each of the individual cylinders can be deactivated in accordance with a predeterminable pattern depending on a required power output, wherein the predeterminable pattern comprises a time sequence of commands for ignition and commands for skipping ignition, and wherein the predeterminable pattern is derived with a calculation specification in such a way that spacing between the individual cylinders intended for skipping in relation to a firing order is an odd number and is preferably in coprime relationship with the number of cylinders.

12 Claims, 2 Drawing Sheets

(56) References Cited

U.S. PATENT DOCUMENTS

| | | | | |
|---|---|---|---|---|
| 8,099,224 | B2 | 1/2012 | Tripathi et al. | |
| 8,131,447 | B2 | 3/2012 | Tripathi et al. | |
| 8,215,284 | B2 * | 7/2012 | Suzuki | F02B 77/08 123/260 |
| 8,336,521 | B2 | 12/2012 | Tripathi et al. | |
| 8,402,942 | B2 * | 3/2013 | Tripathi | F02D 41/0087 123/198 F |
| 9,239,024 | B2 | 1/2016 | Beikmann | |
| 2002/0023615 | A1 | 2/2002 | Dreymuller et al. | |
| 2010/0050993 | A1 | 3/2010 | Zhao et al. | |
| 2012/0055444 | A1 | 3/2012 | Tobergte et al. | |
| 2012/0109495 | A1 | 5/2012 | Tripathi et al. | |
| 2013/0006497 | A1 * | 1/2013 | Silvers | F02D 41/3058 701/103 |
| 2013/0092127 | A1 | 4/2013 | Pirjaberi et al. | |
| 2013/0092128 | A1 | 4/2013 | Pirjaberi et al. | |
| 2013/0289853 | A1 | 10/2013 | Serrano | |
| 2013/0298870 | A1 | 11/2013 | Tripathi et al. | |

FOREIGN PATENT DOCUMENTS

| | | | |
|---|---|---|---|
| DE | 43 10 261 | | 10/1994 |
| FR | 2 601 413 | | 1/1988 |
| FR | 2 690 204 | | 10/1993 |
| FR | 2 809 454 | | 11/2001 |
| FR | 2 965 015 | | 3/2012 |
| JP | 57-35133 | | 2/1982 |
| JP | 2006526735 | A | 11/2006 |
| JP | 2008-115714 | | 5/2008 |
| JP | 2008-215185 | | 9/2008 |
| JP | 2011127550 | A | 6/2011 |
| WO | 2005019629 | A1 | 3/2005 |

OTHER PUBLICATIONS

European Search Report dated Oct. 8, 2015 in corresponding European Application No. 15169352 (with English translation).

Ronald Westerdijk, et al., "Natural-gas-fuelled engines for emergency operation", Wärtsilä Power, Power-Gen Europe, May 6-8, 2003.

Unofficial English translation of Office Action issued in connection with corresponding CN Application No. 201510550900.8 dated May 2, 2017.

Unofficial English translation of Notice of Allowance issued in connection with corresponding JP Application No. 2015112974 dated May 16, 2017.

* cited by examiner

METHOD OF REGULATING AN INTERNAL COMBUSTION ENGINE INCLUDING OMISSION OF CYLINDER FIRINGS

BACKGROUND OF THE INVENTION

1. Field of the Invention

The present invention concerns a method of regulating an internal combustion engine having a plurality of cylinders.

2. Description of Related Art

Methods of cylinder deactivation, referred to as "skip firing", are known from the state of the art. Skip firing is used predominantly in larger engines with more than six cylinders in order to reduce the fuel consumption and emissions when there is a reduced demand for power.

DE 43 10 261 describes that patterns for selective skip firing (referred to in the specification as deactivation patterns) can be predetermined to protect an engine from overloading. The patterns are advantageously matched to the number of cylinders such that there are circulating deactivation sequences, that is to say, each cylinder is relieved of load within a very short time.

It is known from DE 2928075 that the sequence of commands for ignition and for skip firing is selected such that the internal combustion engine runs as smoothly as possible, in particular, harmonics of the resonance frequencies of the engine suspension and the drivetrain are avoided and the operation of individual piston-cylinder units does not cease more frequently than between two and three times so that those piston-cylinder units do not cool down too greatly.

Skip firing methods are further known from US 2013/0289853, US 2013/0298870, U.S. Pat. No. 8,099,224, US 2013/0092128, US 2012/0109495, U.S. Pat. Nos. 8,336,521, 8,131,447 and US 2013/0092127.

It has been found in the applicant's tests that presetting fixed ignition deactivation patterns is detrimental as there is an uncertainty with respect to time in regulation as to whether an individual cylinder does or does not receive the signal for ignition in the next working cycle. Unwanted omission of a cylinder intended for ignition results in a drop in the speed of the engine while unwanted ignition of a cylinder intended to be deactivated leads to an unwanted rise in engine speed.

It is possible to counteract that uncertainty by a crankshaft angle-synchronous control. A crankshaft angle-synchronous control with discrete time presettings for the ignition timing of each cylinder is, however, complicated and expensive.

Even if plural cylinder deactivation patterns are predetermined and those patterns are interchanged, that has the disadvantage that when switching over the patterns plural cylinders make the transition from a fired to an unfired condition and vice-versa. For thermal reasons, however, it is disadvantageous if a cylinder, for example, fires only once and is then deactivated again. In addition, it is detrimental if a status of each of a plurality of cylinders is changed in each cycle (2 crankshaft angle revolutions corresponding to 720° for 4-stroke engines). Thus, in the transition from one cylinder deactivation pattern to another pattern, the situation can arise where plural cylinders which are in succession in their firing sequence are deactivated, that is to say, there is a longer sequence without ignition events.

SUMMARY OF THE INVENTION

Therefore, the object of the invention is to provide an improved method for the omission of cylinder firings, in which the thermal load is more uniformly distributed to the cylinders.

That object is attained by a regulation method according to the invention. Preferred embodiments are recited in the appendant claims.

The fact that the pattern is deduced with a calculation specification in such a way that the spacing between cylinders intended for skipping in relation to the ignition sequence is an odd number, and is preferably in coprime relationship with the number of cylinders, achieves a more uniform input of heat to all of the cylinders.

In the context of the present disclosure, the term "skip" of cylinders is intended to mean that those cylinders do not have ignition, which in turn can be implemented by omission of ignition and/or omission of the fuel feed. The latter is relevant in particular for internal combustion engines which are equipped with a fuel feed individually for each cylinder, for example port-injection valves. The terms "fired" and "unfired" are used synonymously for "ignited" and "non-ignited", respectively.

In the proposed method, the cylinder deactivation pattern (referred to as the skip firing order) is firstly derived from the ignition sequence (referred to as the firing order) of the engine in question. In that respect, the procedure is as follows:

The firing order is a time sequence of the ignition timing points of the individual cylinders, which is predetermined by the crank throws of the crankshaft, that is to say mechanically and invariably for an engine being considered. The firing order is frequently selected such that it involves an application of the torques to the crankshaft, that is distributed advantageously in terms of place and time, the crankshaft as far as possible is not excited to involve torsional oscillations and, when there are two cylinder banks, the mutually opposite cylinders fire in succession.

BRIEF DESCRIPTION OF THE DRAWINGS

The invention will now be described in greater detail with reference to the drawings in which:

FIG. 1 diagrammatically shows a plan view of an internal combustion engine 1. The piston-cylinder units 2 are indicated. FIG. 1 serves to explain the notation with which the cylinders are identified: the arrow symbolizes the direction of view, looking therefore onto a side opposite to a drive output end, identified as G, where counting is begun. Cylinder number one is on the cylinder bank at the left in the direction of view. FIG. 1 shows a V-16 engine.

FIG. 2 serves to illustrate the concept of the rotating skip firing order and shows the firing order in the form of a closed circle, using the example of a 20-cylinder engine in which cylinder number one is excluded from ignition skipping, that is to say it fires regularly. The digits in the fields correspond to the number of the respective cylinder. The fields colored black show ignited cylinders while the white fields show non-ignited cylinders. The sequence of the cylinders corresponds to the skip firing order. The arrows between the fields symbolize the firing order with respect to time.

Figure 1:
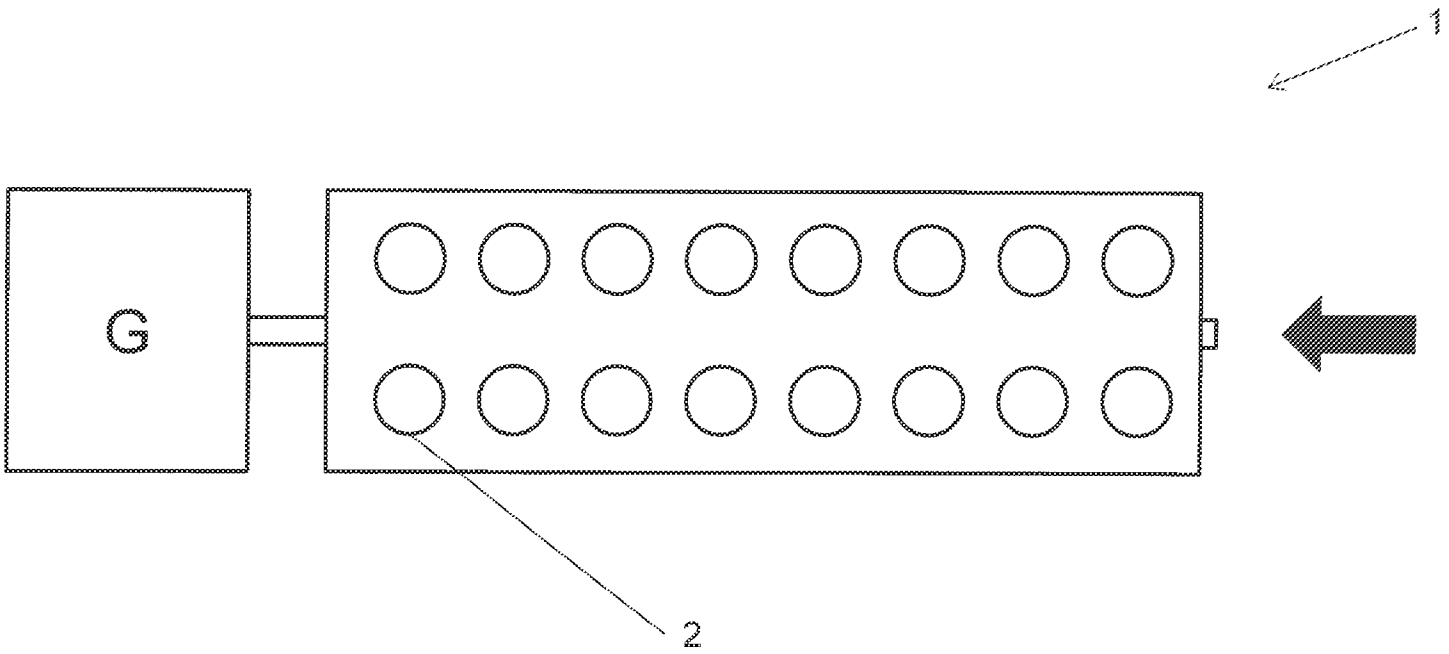
FIG. 1 diagrammatically shows an internal combustion engine of the general kind involved.
Figure 2:
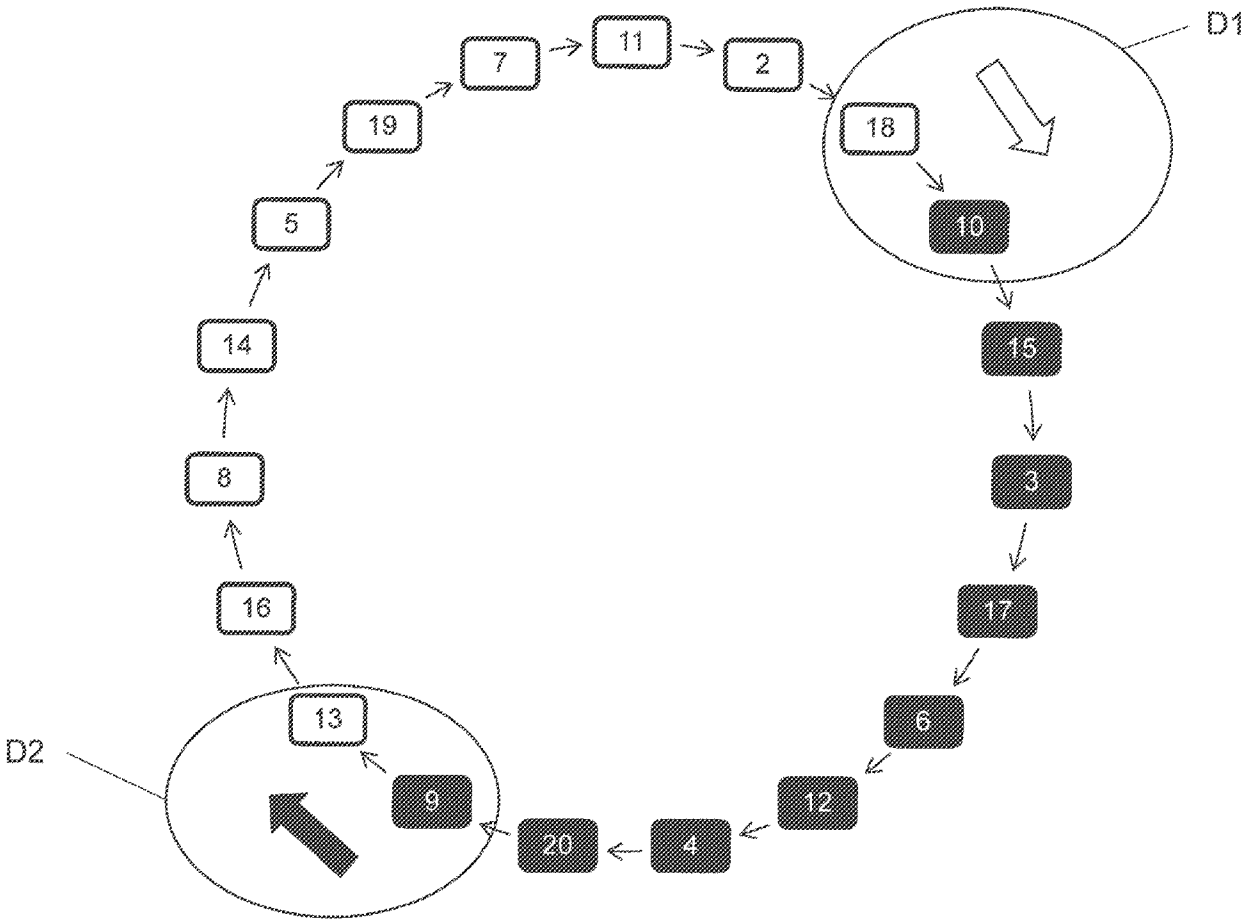
FIG. 2 shows a representation of the firing order in the form of a closed circle.

The block with commands for ignition travels in the circle due to the alteration with respect to time of the skip firing pattern. That is clearly identified by details D1 and D2. Thus, for example, cylinder number ten receives the command for non-ignition (detail D1) and therefore changes its status from ignition to skip. Subsequently, cylinder 13 changes from the condition unfired by the ignition to the fired condition (detail D2). Thus, the number of fired and unfired cylinders respectively remains constant, but the pattern "travels" over the cylinders, thereby giving a uniform input of heat to all of the cylinders.

DETAILED DESCRIPTION OF THE INVENTION

In the usual notation, the cylinders are numbered in such a way that, in relation to the drive output side and when there are plural cylinder banks, the count is begun at the left-hand cylinder bank. Table 1 shows the numbering of the cylinders of a V-20 engine in the form of a two-column Table. The left-hand column with the entries one through ten corresponds to the left-hand cylinder bank while the right-hand column with the entries eleven through twenty corresponds to the right-hand cylinder bank.

TABLE 1

| Numbering of the cylinders of a V-20 engine in the form of a two-column Table: | |
|---|---|
| 10 | 20 |
| 9 | 19 |
| 8 | 18 |
| 7 | 17 |
| 6 | 16 |
| 5 | 15 |
| 4 | 14 |
| 3 | 13 |
| 2 | 12 |
| 1 | 11 |

Usual firing orders for inline engines are:

For inline six-cylinder engines: 1-5-3-6-2-4 or 1-2-4-6-5-3 or 1-4-2-6-3-5 or 1-4-5-6-3-2.

For inline eight-cylinder engines: 1-6-2-5-8-3-7-4 or 1-3-6-8-4-2-7-5 or 1-4-7-3-8-5-2-6 or 1-3-2-5-8-6-7-4.

For V-engines, for example, the following firing orders are commonly involved:

Six-cylinder engines: 1-4-3-6-2-5 or 1-2-5-6-4-3 or 1-4-5-6-2-3.

Twelve-cylinder engines: 1-7-5-11-3-9-6-12-2-8-4-10 or 1-12-4-9-2-11-6-7-3-10-5-8.

In particular, in motor vehicles, there are also many further variants.

Table 2 shows a typical firing order of a V-20 engine. In that respect, the first line shows the time sequence of ignition and the line therebelow shows the number—corresponding to the above-discussed notation—of the respective cylinder. The illustrated firing order corresponds to two crankshaft revolutions in the case of 4-stroke engines and one crankshaft revolution in the case of 2-stroke engines and begins again from the front end after the last cylinder.

TABLE 2

| Firing order of a V-20 cylinder engine | | | | | | | | | | | | | | | | | | | |
|---|---|---|---|---|---|---|---|---|---|---|---|---|---|---|---|---|---|---|---|
| 1 | 2 | 3 | 4 | 5 | 6 | 7 | 8 | 9 | 10 | 11 | 12 | 13 | 14 | 15 | 16 | 17 | 18 | 19 | 20 |
| 17 | 7 | 13 | 3 | 19 | 9 | 15 | 5 | 20 | 10 | 14 | 4 | 18 | 8 | 12 | 2 | 16 | 6 | 11 | 1 |

It is preferably provided that the pattern can be described by way of an algorithm depending on the number of cylinders.

Starting from the firing order, a skip firing order is derived such that the cylinders skip in an odd-numbered sequence.

It can also be provided that the pattern is derived from the firing order by way of an algorithm such that the ignition commands are distributed uniformly to the cylinder banks.

That can be, for example, every third or fifth or seventh cylinder, generally described as two n+1 (2n+1) with n being a natural number. That provides that the omissions are distributed to both cylinder banks. The choice of a coprime number which is not a divisor of the number of cylinders is particularly desirable, for example, three for a 20-cylinder engine or five for a 12-cylinder engine.

If the series comes again to a cylinder which has already been taken into consideration in the skip firing order, that is to say omitted, then that situation involves a departure from the rule and the next cylinder (either forward or back from the cylinder which has already been taken into consideration) which was not yet taken into consideration in the skip firing order is considered. The cylinder following the same and intended for deactivation is again established with the above-defined rule. It will be appreciated that the skip firing order can be begun at any desired cylinder.

Thus, with the rule of (2n+1)=7, from the firing order of a V-12 engine, which reads: 1-7-5-11-3-9-6-12-2-8-4-10, that gives the skip firing order 1-12-5-8-3-10-6-7-2-11-4-9.

In a further example, the spacing 5, that is to say the fifth cylinder after the last one, is adopted as the rule for selection of the cylinder to be skipped.

From the firing order 1-7-5-11-3-9-6-12-2-8-4-10, that gives the following skip firing order: 1-9-4-11-2-7-6-10-3-8-5-12.

The pattern is now varied with respect to time for distribution of the load to the cylinders, in uniform relationship with respect to time:

It can preferably be provided that, after a predeterminable time interval, there is added to a predeterminable list position with a command for ignition a number of at least one further list position with a signal for ignition and the list position with commands for non-ignition is supplemented by an equal number of list positions with signals for non-ignition. List or list position means the following: the ignition deactivation pattern or skip firing order can be constituted as a list of commands for ignition, represented by a one, and commands for skip (non-ignition), represented by a zero. That will be illustrated by means of Table 3 hereinafter. Thus, Table 3 in the first line shows the skip firing order in relation to the cylinder in question, and the line underneath shows the skip commands, represented by a zero, and the ignition commands, represented by a one. In the specific example, cylinders 11, 2 and 18 receive the skip command, followed by cylinders 10, 15, 3, 17, 6, 12, 4, 20, 9 with ignition command, followed by cylinders 13, 16, 8, 14, 5, 19 and 7 with skip command. Skipping is therefore reproduced in the list by a zero while ignition is signaled by a one.

The variation in the skip firing order with respect to time is now effected in such a way that there is added to a predeterminable list position with a command for ignition at least one further list position with a signal for ignition and the subsequent block of commands for non-ignition is supplemented by at least one further list position with a signal for non-ignition. In the specific example that is shown in line 3 of Table 3: cylinder 13 changes from non-ignition to ignition while cylinder 10 changes from the ignited to the non-ignited state.

TABLE 3

| Skip firing order stored with commands for skip (zeros) and ignition (ones) | | | | | | | | | | | | | | | | | | |
|---|---|---|---|---|---|---|---|---|---|---|---|---|---|---|---|---|---|---|
| 11 | 2 | 18 | 10 | 15 | 3 | 17 | 6 | 12 | 4 | 20 | 9 | 13 | 16 | 8 | 14 | 5 | 19 | 7 |
| 0 | 0 | 0 | 1 | 1 | 1 | 1 | 1 | 1 | 1 | 1 | 1 | 0 | 0 | 0 | 0 | 0 | 0 | 0 |
| 0 | 0 | 0 | 0 | 1 | 1 | 1 | 1 | 1 | 1 | 1 | 1 | 1 | 0 | 0 | 0 | 0 | 0 | 0 |

Distribution of the load to the cylinders, which is uniform with respect to time, is therefore effected by the list entry with the firing commands being prolonged by an increment while at the same time the list entry with ignition skip commands is also increased by the same increment.

This therefore involves a displacement of the ignition commands by the selectable increment. That can include, for example, one or more cylinders.

The displacement of the ignition commands by a selectable increment provides that the sequence, or in other words the list position, with commands for ignition in operation of the internal combustion engine "travels", that is to say moves over all of the cylinders.

In a very simple fashion, that affords a possible way of uniformly distributing the load and heat input to the engine.

In a preferred configuration, it is provided that the pattern is altered after a predeterminable time interval, wherein the time interval is between 1 and 20 seconds, particularly preferably being 5-10 seconds. In other words, the firing pattern remains unchanged for 1-20 seconds, particularly preferably 5-10 seconds.

It is preferably provided that the variation with respect to time of the pattern takes place such that as few cylinders as possible, particularly preferably only one cylinder, change over from an unfired to a fired state and as few cylinders as possible change over from a fired to an unfired state. As stated in the opening part of this specification, it is desirable for thermal reasons if, in a period of time under consideration, as few cylinders as possible, and preferably only one cylinder, change their firing status.

It can preferably be provided that at least one cylinder remains excluded from cylinder skipping. For example, for diagnostic purposes, it may be an aspect of interest for a particular cylinder to be excluded from cylinder deactivation.

In deriving the skip firing order for that purpose, the cylinders to be excluded are removed from the firing order and then the above-described method for determining the skip firing order is carried out with the reduced firing order. That is illustrated in Table 4. Table 4 shows the reduced firing order of a V-20 engine wherein the last position, that is to say cylinder number one was deactivated. In that respect, the first line shows the time sequence of ignition and the line underneath shows the number of the respective cylinder. It will be appreciated that cylinder one is not really excluded from ignition, but only from the list for ascertaining the cylinders to be skipped. As there are still nineteen cylinders remaining in the reduced firing order, the step length of five is sufficient, which would in fact be a divisor of the number of cylinders for the 20-cylinder engine.

TABLE 4

| Reduced firing order of a V-20 cylinder engine, cylinder one is excluded | | | | | | | | | | | | | | | | | | |
|---|---|---|---|---|---|---|---|---|---|---|---|---|---|---|---|---|---|---|
| 1 | 2 | 3 | 4 | 5 | 6 | 7 | 8 | 9 | 10 | 11 | 12 | 13 | 14 | 15 | 16 | 17 | 18 | 19 |
| 17 | 7 | 13 | 3 | 19 | 9 | 15 | 5 | 20 | 10 | 14 | 4 | 18 | 8 | 12 | 2 | 16 | 6 | 11 |

If now the rule for ignition skipping is applied to the reduced firing order, then cylinder one remains excluded from ignition skipping. In other words, therefore, cylinder one is quite regularly fired.

The result is intended to be explained using the example of the reduced firing order of Table 4. In that case, the rule of skipping after each third cylinder is applied to the firing order of Table 4. To make it clear that the direction of the ascertaining operation (therefore in the list from left to right or from right to left) and the starting position for the ascertaining operation are immaterial, the procedure is begun at cylinder eleven and moved from right to left. That is to say, after eleven there comes two, after that 18, then ten and so forth. The result, that is to say the skip firing order of the reduced firing order, is shown in Table 5. The resulting skip firing order for the 20-cylinder engine has only 19 entries as in fact a cylinder is excluded from ignition skipping.

TABLE 5

| Skip firing order of the reduced firing order of a V-20 cylinder engine | | | | | | | | | | | | | | | | | | |
|---|---|---|---|---|---|---|---|---|---|---|---|---|---|---|---|---|---|---|
| 11 | 2 | 18 | 10 | 15 | 3 | 17 | 6 | 12 | 4 | 20 | 9 | 13 | 16 | 8 | 14 | 5 | 19 | 7 |

That skip firing order, however, is still not adapted to a specific load demand but only describes the sequence which is to be followed in cylinder skipping.

The proposed method now involves superposing on the skip firing order obtained, a further pattern establishing which of the cylinders defined in the skip firing order are actually intended for non-ignition.

That pattern can be constituted as a list or sequence of commands for non-ignition, expressed by a zero, followed by list entries with a one, for the command for ignition.

If now that pattern is superposed with the previously established skip firing order, then the number of cylinders actually to be skipped can be established and thus adapted to a load demand. The method will be illustrated with Table 6 hereinafter. Table 6 again follows the example of the reduced firing order, wherein cylinder one is excluded from skipping. That can be provided, for example, for diagnostic purposes or the like. The load demand will be assumed in the example such that ten of the twenty cylinders are to have ignition. Thus, Table 6 in the first line shows the ignition deactivation pattern or skip firing order in relation to the cylinder in question, and the line underneath shows the commands for skipping, represented by a zero, and the commands for ignition, represented by a one, respectively. In the specific example, cylinders 11, 2 and 18 receive the command for skipping, followed by cylinders 10, 15, 3, 17, 6, 12, 4, 20, 9 with the command for ignition, followed by cylinders 13, 16, 8, 14, 5, 19 and 7 with the command for skipping. Skipping is therefore reproduced in the list by a zero while ignition is signaled by a one.

TABLE 6

| Skip firing order stored with commands for skipping (zeros) and ignition (ones) | | | | | | | | | | | | | | | | | | |
|---|---|---|---|---|---|---|---|---|---|---|---|---|---|---|---|---|---|---|
| 11 | 2 | 18 | 10 | 15 | 3 | 17 | 6 | 12 | 4 | 20 | 9 | 13 | 16 | 8 | 14 | 5 | 19 | 7 |
| 0 | 0 | 0 | 1 | 1 | 1 | 1 | 1 | 1 | 1 | 1 | 1 | 0 | 0 | 0 | 0 | 0 | 0 | 0 |

Illustrated in the form of list entries, that therefore gives a sequence of entries with signal for ignition, represented by ones, followed by a sequence of entries with the information relating to ignition skipping, shown by zeros. It will already be seen from the example for Table 6 that it is very easily possible in that way to establish the proportion of those cylinders which are intended to continue to have ignition, in other words, for what load proportion the engine is to be operated. In the example of Table 6, ten out of twenty cylinders have ignition, that is to say the load reduction is around 50%.

Particularly preferably it can be provided that, with an increased power requirement, the list block with commands for ignition is prolonged by at least one further command for ignition.

If therefore the load demand rises, that can easily be achieved by prolonging the sequence of entries with signals for ignition by a further increment. Increment means at least one list entry.

Table 7 shows, for example, that the sequence of entries with commands for ignition, that is to say list entries with one, is increased by a further list entry. In the specific example, cylinder 13 is now also intended for ignition.

TABLE 7

| 11 | 2 | 18 | 10 | 15 | 3 | 17 | 6 | 12 | 4 | 20 | 9 | 13 | 16 | 8 | 14 | 5 | 19 | 7 |
|---|---|---|---|---|---|---|---|---|---|---|---|---|---|---|---|---|---|---|
| 0 | 0 | 0 | 1 | 1 | 1 | 1 | 1 | 1 | 1 | 1 | 1 | 1 | 0 | 0 | 0 | 0 | 0 | 0 |

In that way, the number of fired cylinders is increased to eleven while nine cylinders remain unfired.

It is preferably provided that the pattern can be altered with respect to time such that, upon a reduced power demand, the list block with commands for ignition skipping is prolonged by at least one further command for ignition skipping.

Table 8 shows that situation. Here, the sequence of non-ignitions is prolonged by a further list entry so that now eleven cylinders do not have ignition and nine cylinders involve ignition. It is thus possible to achieve a further power reduction. In the specific case, in comparison with the starting condition, as shown in Table 6, cylinder number ten additionally skips.

TABLE 8

| 11 | 2 | 18 | 10 | 15 | 3 | 17 | 6 | 12 | 4 | 20 | 9 | 13 | 16 | 8 | 14 | 5 | 19 | 7 |
|---|---|---|---|---|---|---|---|---|---|---|---|---|---|---|---|---|---|---|
| 0 | 0 | 0 | 0 | 1 | 1 | 1 | 1 | 1 | 1 | 1 | 1 | 0 | 0 | 0 | 0 | 0 | 0 | 0 |

The specified examples show the situation which is unchanged with respect to time, that is to say always the same cylinders have ignition while the remaining cylinders remain unfired. As described hereinbefore, the pattern is altered with respect to time for distribution of the load to the cylinders, uniformly with respect to time.

If the firing order is envisaged as a closed circle in which the last-ignited cylinder adjoins the first-ignited cylinder then the block of ignited cylinders now rotates in the circle.

The invention claimed is:

1. A method of regulating an internal combustion engine having a number of cylinders, comprising:

deriving a predeterminable pattern comprising a time sequence of ignition commands for ignition of individual cylinders of the number of cylinders and non-ignition commands for skipping ignition of the individual cylinders of the number of cylinders, wherein the predeterminable pattern is derived by a calculation with spacing between the individual cylinders derived for non-ignition commands in relation to a firing order is an odd number;

varying with respect to time, after a predeterminable time interval, the predeterminable pattern by adding ignition commands for a number of at least one individual cylinder and by adding non-ignition commands for the same number of at least one individual cylinder;

excluding a number of at least one individual cylinder from non-ignition commands of the predeterminable pattern for regular ignition without adaptation to a load demand; and activating or deactivating individual cylinders of the predeterminable pattern depending on a required power output by the internal combustion engine.

2. The method as set forth in claim 1, wherein the predeterminable pattern is derived by way of an algorithm depending on the number of cylinders.

3. The method as set forth in claim 1, wherein the number of cylinders comprises cylinder banks, and the predeterminable pattern is derived by way of an algorithm from the firing order with the commands for ignition distributed uniformly to the cylinder banks of the number of cylinders.

4. The method as set forth in claim 1, wherein the predeterminable time interval is between 1 and 20 seconds.

5. The method as set forth in claim 1, wherein varying with respect to time the predeterminable pattern is with a minimal number of cylinders changing from non-ignition commands to ignition commands and a minimal number of cylinders changing from ignition commands to non-ignition commands to achieve the required power output by the internal combustion engine.

6. The method as set forth in claim 1, wherein the predeterminable pattern is varied with respect to time, upon an increased power demand on the internal combustion engine, with ignition commands prolonged by at least one additional ignition command.

7. The method as set forth in claim 1, wherein the predeterminable pattern is varied with respect to time, upon a reduced power demand on the internal combustion engine, with non-ignition commands prolonged by at least one additional non-ignition command.

8. The method as set forth in claim 1, wherein the spacing between the individual cylinders derived for non-ignition commands in relation to the firing order is in coprime relationship with the number of cylinders.

9. The method as set forth in claim 4, wherein the predeterminable time interval is 5-10 seconds.

10. The method as set forth in claim 5, wherein only one of the number of cylinders changes from non-ignition commands to ignition commands.

11. The method as set forth in claim 10, wherein only one of the number of cylinders changes from ignition commands to non-ignition commands.

12. The method as set forth in claim 5, wherein only one of the number of cylinders changes from ignition commands to non-ignition commands.

* * * * *